US012312896B2

(12) United States Patent
Ricci Maccarini et al.

(10) Patent No.: US 12,312,896 B2
(45) Date of Patent: May 27, 2025

(54) VALVE AND METHOD FOR CLOSING EXTRACTION WELLS UNDER EMERGENCY CONDITIONS

(71) Applicant: ENI S.P.A., Rome (IT)

(72) Inventors: Giorgio Ricci Maccarini, San Donato Milanese (IT); Roberto Poloni, San Donato Milanese (IT); Davide Tagliaboschi, Rome (IT); Andrea Biondi, Venezia Marghera (IT)

(73) Assignee: ENI S.P.A., Rome (IT)

( * ) Notice: Subject to any disclaimer, the term of this patent is extended or adjusted under 35 U.S.C. 154(b) by 0 days.

(21) Appl. No.: 18/246,573

(22) PCT Filed: Sep. 24, 2021

(86) PCT No.: PCT/IB2021/058736
§ 371 (c)(1),
(2) Date: Mar. 24, 2023

(87) PCT Pub. No.: WO2022/064444
PCT Pub. Date: Mar. 31, 2022

(65) Prior Publication Data

US 2023/0366286 A1 Nov. 16, 2023

(30) Foreign Application Priority Data

Sep. 28, 2020 (IT) ..... 102020000022756

(51) Int. Cl.
*E21B 33/06* (2006.01)

(52) U.S. Cl.
CPC ..... *E21B 33/063* (2013.01)

(58) Field of Classification Search
CPC ..... E21B 29/08; E21B 33/061; E21B 33/063
See application file for complete search history.

(56) References Cited

U.S. PATENT DOCUMENTS 3,561,526 A * 2/1971 Williams, Jr. ..... E21B 33/063 83/639.1
5,029,643 A * 7/1991 Winslow ..... E21B 33/1291 166/131

(Continued)

OTHER PUBLICATIONS

International Search Report for International Application No. PCT/IB2021/058736, dated Dec. 3, 2021, 4 pages.

(Continued)

*Primary Examiner* — Robert E Fuller
*Assistant Examiner* — Lamia Quaim
(74) *Attorney, Agent, or Firm* — CANTOR COLBURN LLP

(57) ABSTRACT

A safety valve for wells for the extraction of hydrocarbons is described which allows the cutting of the tubular drilling material possibly present in the safety valve and the closure of the well with a hydraulic seal, allowing the subsequent application of appropriate intervention plans to control the well in case the BOPs are not effective. A safety valve for wells for the extraction of hydrocarbons is described which is able to perform the action of cutting the tubular material with a higher capacity than conventional BOPs, considering the worst conditions of compound stresses at the wellhead, which are not contemplated by such BOPs today. In particular, the safety valve is capable of cutting/shearing a wide range of tubular elements in its inside.

14 Claims, 5 Drawing Sheets

(56) References Cited

U.S. PATENT DOCUMENTS

| | | | | |
|---|---|---|---|---|
| 9,752,405 | B1 | 9/2017 | Jennings et al. | |
| 2007/0246215 | A1* | 10/2007 | Springett | E21B 33/063 166/85.4 |
| 2016/0258238 | A1 | 9/2016 | Vargas et al. | |
| 2017/0058628 | A1 | 3/2017 | Van Wijk et al. | |
| 2017/0130549 | A1 | 5/2017 | Kroesen | |
| 2017/0218717 | A1* | 8/2017 | Brinsden | E21B 33/063 |
| 2017/0314355 | A1* | 11/2017 | Ferrara | E21B 33/064 |
| 2018/0058170 | A1 | 3/2018 | Anderson et al. | |
| 2019/0017343 | A1* | 1/2019 | Lambert | E21B 33/063 |
| 2019/0211644 | A1 | 7/2019 | Norbom | |

OTHER PUBLICATIONS

Written Opinion for International Application No. PCT/IB2021/058736, dated Dec. 3, 2021, 5 pages.

* cited by examiner

VALVE AND METHOD FOR CLOSING EXTRACTION WELLS UNDER EMERGENCY CONDITIONS

CROSS-REFERENCE TO RELATED APPLICATIONS

This application is a 35 U.S.C. § 371 National Stage patent application of PCT/IB2021/058736 filed 24 Sep. 2021, which claims the benefit of Italian patent application 102020000022756 filed 28 Sep. 2020, the disclosures of which are incorporated herein by reference in their entirety.

TECHNICAL FIELD

The present disclosure relates to a valve and method for controlling extraction wells, such as wells for the extraction of hydrocarbons (oil and/or gas), under emergency conditions due to the loss of the normal operating conditions and consequent uncontrolled blow out.

BACKGROUND

The growing tendency of the Oil & Gas industry of exploring in offshore areas at ever greater depths leads to the need to guarantee a continuous improvement in the level of safety for wellheads both onshore and on the seabed or ocean floors at depths of up to near 4,000 metres; the capacity and effectiveness of intervention in the event of an emergency is a necessity and a challenge for the future, which directs technology towards safety solutions that integrate the current performance of the blow-out preventers (BOP) with new systems that can be installed on the wellheads.

Currently, the blow-out preventers are redundantly installed devices to ensure an effective intervention in the event of an emergency.

The main functions of the BOPs are to control well fluid volumes, to centre drill pipes, and to close and seal the well. There are mainly two BOP categories: annular and "ram". The annular devices adopt an element for controlling the volume of the fluids and closure of the well with an annular shape and of elastomeric material, whereas the ram devices implement a gate or guillotine mechanism in metallic or elastomeric material capable of carrying out a closing and hydraulic sealing action with or without the presence of tubular material inside the device. Particular BOPs called "shear rams" can induce shear stresses on the tubular materials engaged in the valve body of the BOP in order to shear them to achieve the desired results.

Normally, a well blow-out prevention system is composed of a series of redundant BOPs that exploit multiple operating systems (annular and ram) to ensure a greater effectiveness. BOP intervention times typically range from tens of seconds to minutes thanks to dedicated hydraulic actuations and controls. Although the barrier formed by BOPs represents an important safety against emergency events, some limitations on the operation thereof are evident.

The capacity of shearing drill pipes engaged in the BOPs is limited and does not comprise shearing tool joints with thickness and diameter greater than the pipes themselves. It is necessary to maintain the BOP and replace the seals at the end of the drilling operations. In case of shearing with systems that induce shear rams, the cutting action on the drill pipe takes place in such a way as to guarantee the separation of the two pipe portions and the subsequent closure of the well if the pipe is in a centred position with respect to the passage duct of the valve. In cases where the drilling string is compressed by the pressure of the well or if it is deflected laterally, its shearing may be incomplete or with residual material deformed to such an extent that it does not allow the subsequent step of closing the well by means of a sealing element. The passage of the cutting elements requires that the pipe is sheared after a complete crushing of the section, which occurs only in the central part of the pipe.

The area of the tool joint, subject to the action of the cutting elements, tends to break with reduced crushing and with unpredictable fracture lines; consequently, some metallic projections could become trapped blocking the stroke of the cutting elements and therefore preventing the well from closing. Furthermore, the traditional systems for cutting tubular material that may be engaged in the safety valves also entail the risk of impossibility of subsequent reopening of the well as the two portions of tubular material generated by the shearing operation tend, due to the irregularities of the separation surfaces, to block the moving elements of the valve preventing a reversible actuation.

SUMMARY

The present disclosure realises a valve that overcomes the drawbacks of the prior art, allowing the well to be closed even after any ineffective intervention of the BOPs.

According to the present disclosure, a safety valve for hydrocarbon extraction wells has been realised, which allows cutting drilling tubular material that may be present in the safety valve, closing the well with a hydraulic seal and the subsequent reopening of the well.

According to the present disclosure, a safety valve for hydrocarbon extraction wells has been realised which is able to perform the action of cutting the tubular material with a higher capacity than the conventional BOPs, considering the worst conditions of compound stresses at the wellhead, which are not contemplated by such BOPs today. In particular, the safety valve according to the disclosure is capable of shearing a wide range of tubular elements within it, including: casings with outer diameter preferably from 1" to 20", with wall thickness preferably up to about 20 mm, drill pipes with outer diameter preferably from 1" to 10", with wall thickness preferably up to about 20 mm, and tool joints with outer diameter preferably from 1" to 10", with wall thickness preferably up to about 40 mm.

Therefore, the present disclosure provides a safety valve V comprising a valve body 1, inside which is formed a crossing duct 20, predisposed to be crossed by a production or drilling line predisposed to contain and transport, through a tubular element 26, extraction fluids or other fluids to be extracted from an underground field, the valve V being provided with a cutting shutter 2 selectively sliding linearly in a controlled manner along an axis A2 which intersects in a substantially orthogonal manner the longitudinal axis A1 of the crossing duct 20, the valve V being characterized by the fact that:

- the cutting shutter 2 comprises a through opening 8 in the direction of the longitudinal axis A1, the through opening 8 extending on the side facing the tubular element 26 substantially configuring a "U" opening, suitable for internally smoothly receiving a tubular material portion 27 in linear motion during the shearing operation;
- the cutting shutter 2 comprises cutting inserts 28, 29 in a material of higher hardness than that of the cutting shutter 2, installed on the edges of the through opening 8, the cutting inserts 28, 29 define two different shearing planes TS (upper shearing plane) and TI (lower shearing plane) in the tubular element 26;

The present disclosure also provides an extraction well comprising the valve V object of the present disclosure, as described below.

The present disclosure further provides a method for intervening to close an extraction well under emergency conditions comprising the actuation of the valve V, as described below.

Further characteristics of the disclosure are highlighted by the dependent claims, which are an integral part of the present description.

BRIEF DESCRIPTION OF THE DRAWINGS

The characteristics and advantages of the present disclosure will become clear from the following description of a non-limiting example of an embodiment thereof, with reference to the figures of the attached drawings, in which.

DETAILED DESCRIPTION OF THE DRAWINGS

Figure 1:
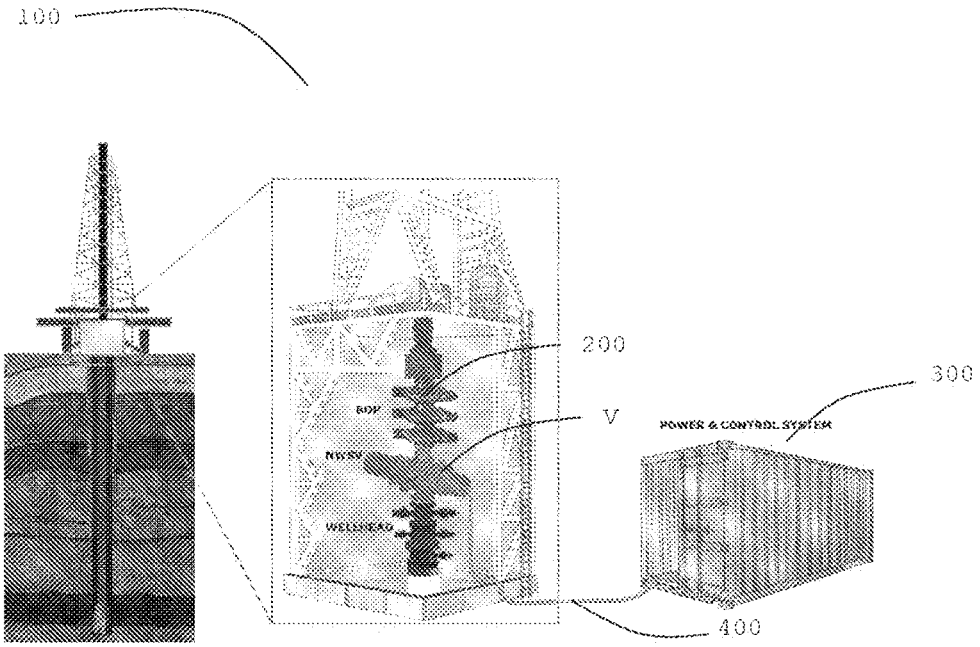
FIG. 1 is a schematic view of the drilling system comprising the safety valve according to the disclosure and the related auxiliary systems useful for the operation thereof.

With particular reference to FIG. 1, a generic drilling rig 100 is shown. The safety valve according to the disclosure, indicated overall by reference V, is installed on the wellhead in such a way as to allow, during the drilling step, the installation of the blow-out preventers (BOP), indicated overall by the reference number 200. The wellhead can be of any type. More particularly, the wellhead can comprise a cemented anchoring tube. The production X-mass Tree can also be of a known type. At the end of drilling, unlike the BOPs 200, which are removed, the safety valve V can remain installed for the entire operating life of the well. After installation, the safety valve V can be left on the wellhead even during the production step, when the BOP has been removed.

Figure 2:
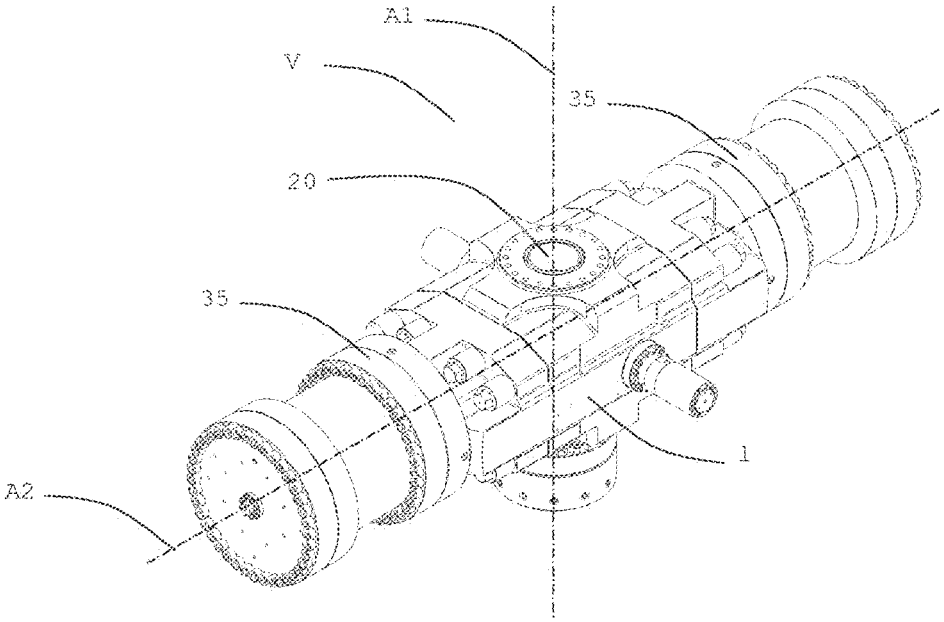
FIG. 2 is axonometric view with parts in section of the safety valve, with components removed for clarity's sake, showing the valve body, the cutting shutter with relative actuation mechanisms.
Figure 3:
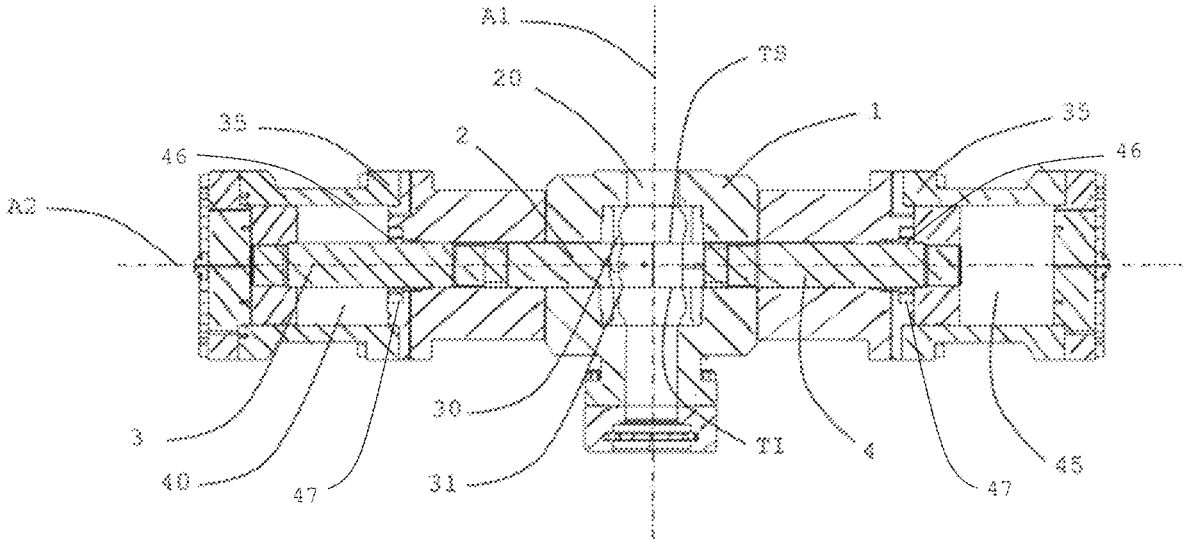
FIG. 3 is a sectional view of the safety valve, with components removed for clarity's sake, showing the valve body, the cutting shutter and the closing collar with relative actuation mechanisms.

In particular, with reference to FIGS. 2 and 3, the safety valve V is configured to allow it to be crossed by a tubular element 26, typically metallic, contained at least partially inside the well and oriented in the same axial direction as the well itself. The tubular element 26 is internally hollow and is predisposed to contain and transport the fluids and other substances extracted through the well, including for example hydrocarbons (oil or natural gas), water, mud, rock debris and/or soil debris. The safety valve V is operated by a remote power and control system 300 that can be installed both at a drilling site (in the case of onshore drilling) and on the seabed (in the case of offshore drilling), at a predefined distance from the well. The power and control system 300 is characterised by the fact that it is completely independent of other systems in the drilling group and therefore allows a separated power supply and control with respect to the systems that govern the normal well operations. The technical characteristics of the safety valve V, as will be further specified below, are such that no maintenance is required during the operating life of the safety valve V itself. The remote power and control system 300 can be instead removed for both scheduled and occasional maintenance. In the case of offshore drilling, the electrical and hydraulic connections 400 between the remote power and control system 300 and the safety valve V may be made by means of an underwater ROV ("remotely operated vehicle"), using connectors known as "ROV-mateable connectors".

In this description, the expressions "lower" and "upper" indicate respectively the nearest and furthest positions from the reservoir in which the extraction well is carried out.

As can be seen from FIG. 2, the following two cutting planes can be identified in the valve body 1:

- the upper cutting plane TS substantially orthogonal to the longitudinal axis A1 of the valve and containing the upper face of the cutting shutter 2;
- the lower cutting plane TI substantially orthogonal to the longitudinal axis A1 of the valve and containing the lower face of the cutting shutter 2;

With reference to FIGS. 2, 3, 4 and 5, an example of a preferred embodiment of the safety valve V according to the disclosure is shown, comprising a valve body 1 inside which is formed a crossing duct 20, preferably straight, predisposed to be crossed by a production or drilling line predisposed to contain and transport, through a tubular element 26, extraction fluids such as for example crude oil, oil, water, mud, rock debris and/or soil debris, natural gas, or other fluids to be extracted from an underground reservoir. The valve body 1 is provided with upper and lower removable junction means, preferably flanged couplings, to allow the connection of the valve V to the production X-mass Tree and/or to the wellhead. The housings for the cutting shutter 2 and the closing collar 5 are formed in the valve body 1, which are arranged diametrically opposite to each other with a common longitudinal axis A2 substantially perpendicular to the longitudinal axis A1 of the crossing duct 20; the valve V is provided with a cutting shutter 2 sliding linearly in a controlled manner in the housing along the axis A2 which intersects the longitudinal axis A1. The cutting shutter 2 is configured to resist the vertical thrust due to the pressure of the well fluids, not causing a significant bending thereof. The valve V is characterized by the fact that the cutting shutter 2 defines two different cutting planes by smoothly receiving in the hollow part inside it the tubular portion 27 sheared according to the two upper TS and lower TI cutting planes.

The cutting shutter 2 comprises cutting inserts 28 and 29 which are positioned on the edges of the through opening 8. Said inserts allow the tubular element 26 to be cut effectively and the shearing mechanism to be set up. The hardness of the material of the cutting inserts 28 and 29 is higher than that of the base material of the cutting shutter 2.

The tubular elements 26 can be casings, production tubings or pipe strings comprising drill pipes and tool joints in the technical jargon.

Figure 6:
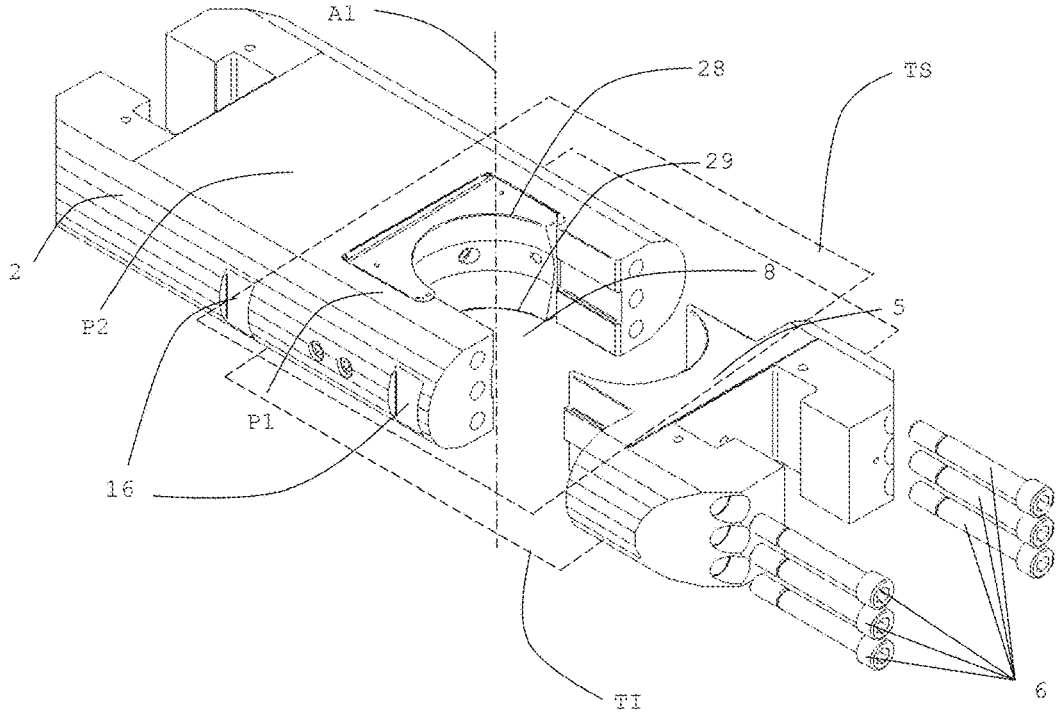
FIG. 6 is an axonometric view of the cutting shutter and of the closing collar, with parts removed for clarity's sake, showing the programmed collapse coupling means.

As can be seen in FIGS. 3 and 6, in a preferred embodiment of the disclosure the valve body 1 comprises abutment cutting inserts 30, 31, installed inside the crossing duct 20 in a manner respectively opposite to the cutting inserts 28, 29 contributing to the definition of the two different cutting planes TS and TI. During the shearing operation, in the controlled linear feed motion of the cutting shutter 2, the combined presence of the cutting inserts 28, 29 and of the abutment cutting inserts 30, 31 configures a stress state in the tubular element 26 in which the shear stress cutting is facilitated and the establishment of an upper cutting plane TS and a lower cutting plane TI guarantees a greater neatness of the cut of the tubular portion 27 with defined cutting edges and without burrs that can interfere with subsequent operations for closing the safety valve V.

In a further preferred embodiment of the disclosure according to any of the previously described embodiments, the cutting inserts 28, 29 are configured with a "U" shape or a "V" shape in their part that comes into contact with the tubular element 26 so as to exert a centering function of the aforesaid tubular element when said punches engage the tubular element 26. This specific configuration of the cutting inserts 28, 29 allows the shearing of tubular elements 26 even under critical conditions with the drill string locked in the BOP, with tubular elements off axis and in compression due to the thrust exerted by the well fluids.

In a further preferred embodiment of the disclosure, the valve V as from any of the previously described embodiments is characterized in that the cutting shutter 2 comprises a closing collar 5, coupled with the cutting shutter 2 on the side facing the tubular element 26 by programmed failure coupling means 6 (shear coupling), so as to configure the through opening 8 as having a substantially circular section and in such a way that, in predetermined conditions of stress state, the programmed failure means 6 collapse releasing the cutting shutter 2 from the closing collar 5.

Figure 5:
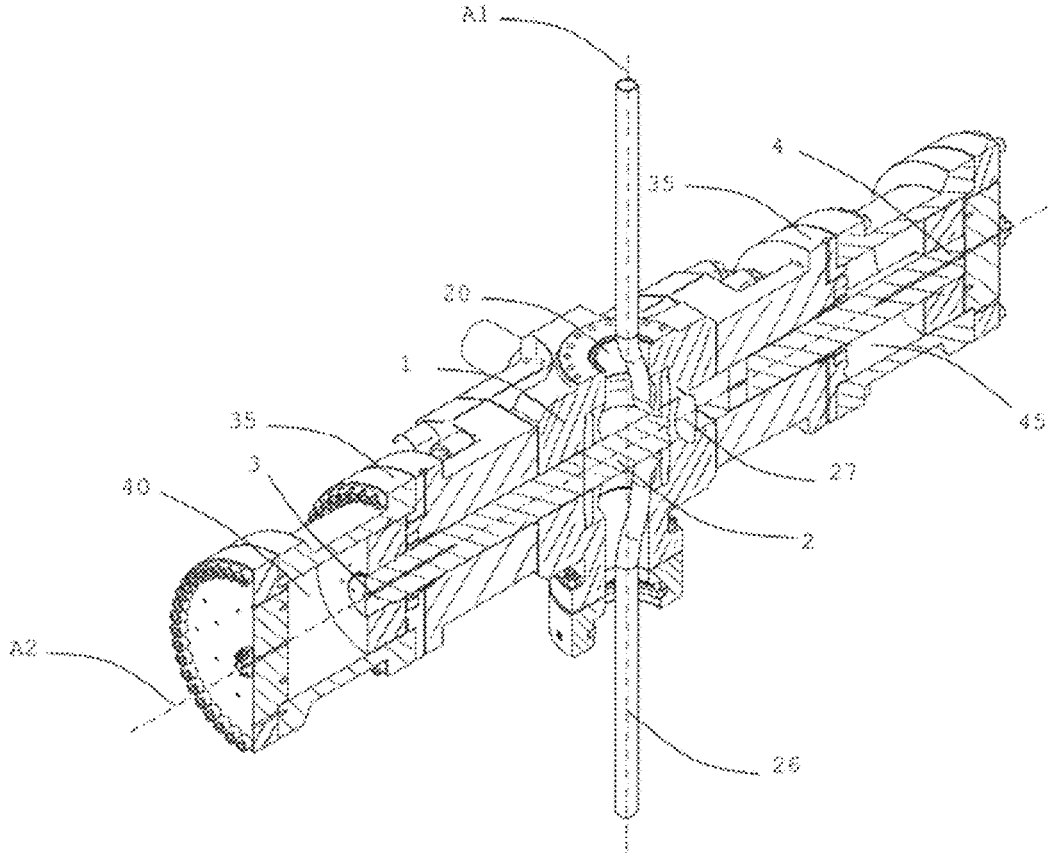
FIG. 5 is an axonometric view with parts in section of the safety valve, with components removed for clarity's sake, showing the valve body, the cutting shutter, the closing collar with relative actuation mechanisms, the valve being in the closed condition with a sheared tubular element.

As is evident in FIG. 5, after the shearing operation, the cutting shutter 2 removes the tubular portion 27 from the crossing duct 20 continuing the linear stroke to close the passage to the well fluids. Since the safety valve V according to the disclosure provides for a subsequent re-opening manoeuvre, under certain conditions, during the reversal of the motion direction of the stroke of the cutting shutter 2 to restore the opening of the crossing duct 20, the presence of metal debris may occur or particular plastic conformations of the tubular portion 27 may show up which prevent the retrograde motion of the cutting shutter-closing collar group. In these cases, by monitoring the movement of the cutting shutter 2, it is possible to identify any blockages in the translating movement; in the event of difficulties in the movement of the cutting shutter 2, it is possible, by acting on the movement means of the cutting shutter 2 and of the closing collar 5, to induce a predetermined stress state, such as to bring about the collapse of the programmed collapse coupling means 6. In this way, since the cutting shutter 2 is released from the sealing collar 5, the retrograde motion of the shutter in order to re-establish the opening of the safety valve 5 does not involve dragging the tubular portion 27, thus eliminating any interference with the valve body 1.

In a preferred embodiment of the disclosure, as described in FIG. 6, the programmed failure coupling means (6) may be borrowed from solutions already known in the state of the art, such as screws, bolts, plugs and pins of material and dimensions configured to reach a collapse in predetermined conditions of stress state. In a preferred configuration of the disclosure, the programmed collapse coupling means are arranged with longitudinal axis substantially parallel to the axis A2. Said programmed collapse couplings may comprise at least a notch designed to the determination of predefined failure zones. The notches or the resistant sections of the programmed collapse coupling means can be provided so as to facilitate the failure in predetermined directions generated by tensile or shear stresses or a combination thereof.

In a further preferred embodiment of the disclosure, the valve V, as from any of the previously described embodiments, is characterized in that the cutting shutter 2 is moved by means of a double-acting main hydraulic cylinder 40 whose main hydraulic piston 3 is connected to the cutting shutter 2. The adoption of a double-acting hydraulic cylinder allows the cutting shutter 2 to be moved both in the shearing and closing step of the safety valve V, and in the subsequent reopening step, selectively energizing the hydraulic chambers enslaved to the specific movement.

In a further preferred embodiment of the disclosure, the valve V comprises a double-acting secondary hydraulic cylinder 45 whose secondary hydraulic piston 4, connected to the closing collar 5, is substantially coaxial and diametrically opposite to the main hydraulic piston 3. The adoption of the secondary hydraulic cylinder 45 makes it possible to assist the movement of the cutting shutter 2 and furthermore, in case of need, it operates in contrast with the main cylinder 3 so as to generate the stress state necessary to cause the collapse of the coupling means. 6.

The main hydraulic cylinder 40 and the secondary hydraulic cylinder 45 are mounted on the valve body 1 by means of removable joints, preferably flanged 35.

In a preferred embodiment of the disclosure, the seals 46 of the hydraulic pistons 3, 4 are protected from the well fluids by elastic bellows 47, preferably metallic or of PTFE. The elastic bellows allow small movements of the relative pistons. These movements, imposed at regular intervals (in the order of 1-2 months), are useful for lubricating the hydraulic seals 46, avoiding sticking and guaranteeing the necessary reliability over the long term (exploration step and production step of the well). When the valve V is actuated, the force of the pistons 3, 4 shears the fixing elements of the bellows 47 to the pistons, which then continue in the stroke required to perform the specific functions.

This system allows the seals to be isolated from the well fluids avoiding damage to the protective bellows.

Figure 7:
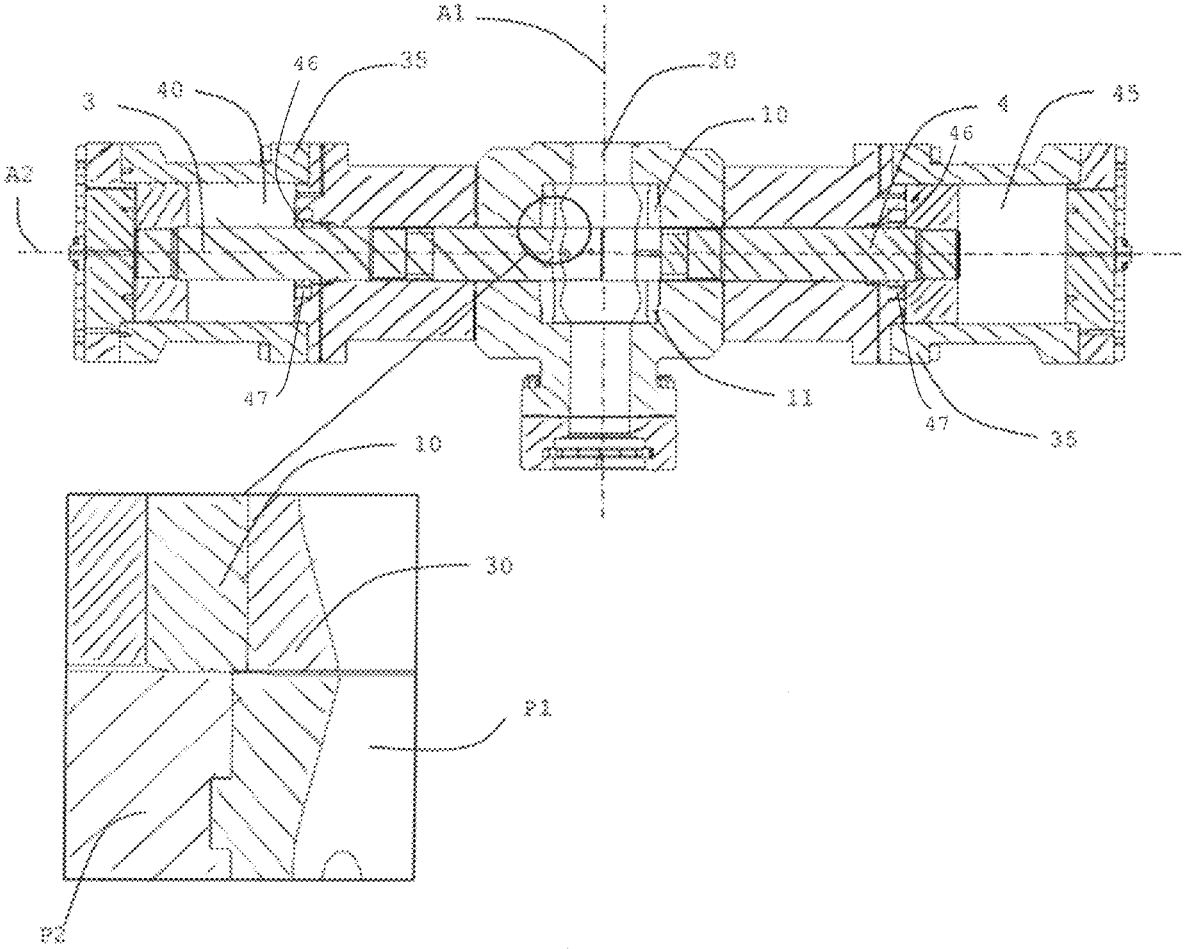
FIG. 7 is a view with parts in section of the safety valve showing the detail of the hydraulic seal of the safety valve in closed condition and a detail of the cutting shutter in which the variation in thickness of the same along the axis A2 is highlighted.
Figure 9:
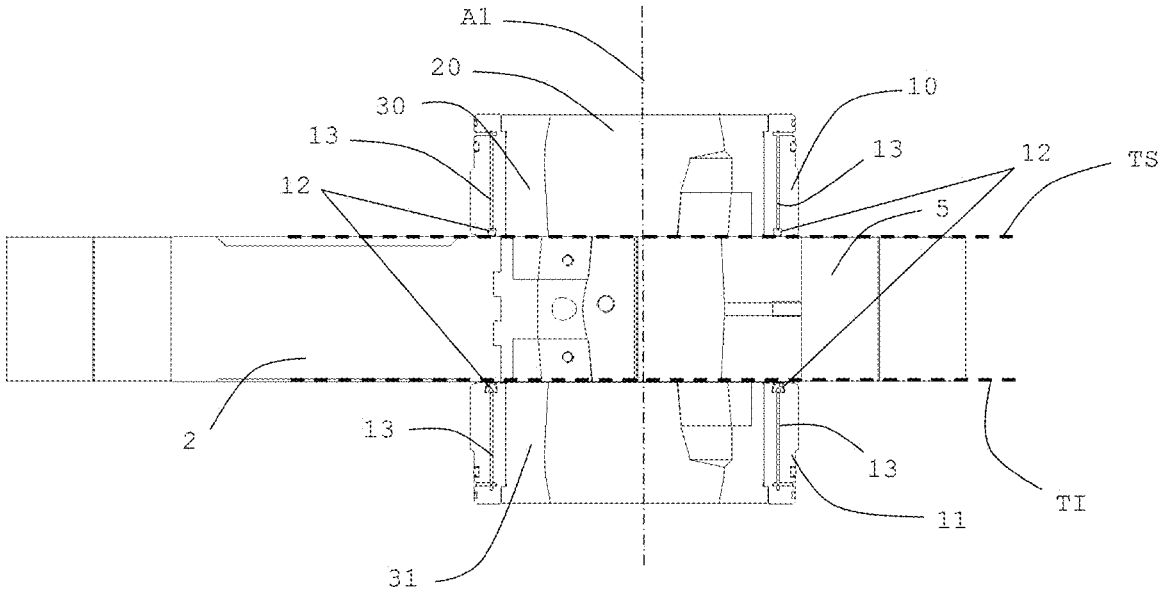
FIG. 9 is a view with parts in section of the safety valve, with components removed for clarity's sake, showing the detail of the gaskets and relative pressurizable fluid circuit to energize said gaskets.

With reference to FIG. 7, in a further preferred embodiment of the disclosure the valve V, as from any of the previously described embodiments, comprises a first hydraulic sealing collar 10 and a second sealing collar 11, installed in a seat formed in the valve body 1 facing the crossing duct 20; moreover, the cutting shutter 2 comprises a first portion P1, equipped with cutting inserts 28, 29, characterized by a first thickness S1 and a second portion P2 characterized by a second thickness S2, greater than the first thickness S1, so that, in the linear sliding feed motion, once the shearing of the tubular element 26 has taken place, the cutting shutter 2 is engaged, on its upper surface of the second portion P2, in an interfering manner with the first hydraulic seal collar 10, on its lower surface of the second portion P2, in an interfering manner with the second hydraulic sealing collar 11, thus making the hydraulic seal. The safety valve V therefore achieves a closure with hydraulic seal through the hydraulic seal collars 10 and 11, which are forcibly interfering with the surface of the cutting shutter 2 in the second portion P2 with thickness S2 greater than S1. The particular configuration of the cutting shutter 2 allows its free movement in its first portion P1 with thickness P1 as this portion does not interfere with the sealing collars 10 and 11; when the advancement of the cutting shutter 2 brings the second portion P2 in contact with the sealing collars 10 and 11 due to its increased thickness S2, the seal is developed by interference on the upper and lower surfaces of the cutting shutter 2. As described above, the material of the cutting shutter 2 differs from that of the cutting inserts 28, 29 in that it has a lower hardness. By assigning the incision and cutting function of the tubular element 26 to the harder cutting inserts 28, 29, it allows achieving the hydraulic seal in a zone characterised by softer materials such as those of the second portion P2 and of the hydraulic seal collars 10 and 11. This makes it easier to comply with the requirements of the international NACE standards (e.g. MR0175/ISO 15156) with regard to the behaviour of metallic materials in an environment containing hydrogen sulphide (H2S) and to acquire the necessary certifications for the safety valve V object of the disclosure. With reference to FIG. 9, in order to improve the hydraulic seal of the valve V under closed conditions, in a further preferred configuration of the valve V, as described in any of the embodiments described above, the hydraulic sealing collars 10 and 11 are provided with gaskets 12, energizable by means of a selectively pressurizable fluid, in order to ensure an engagement of the gaskets 12 with the upper and lower surfaces of the cutting shutter 2. Subsequent to the shearing operation of the tubular element 26 engaged in the crossing duct 20, when the cutting shutter 2 has reached the closed position of the valve V and the hydraulic sealing collars 10 and 11 insist respectively on the upper and lower surfaces of the portion P2 of the same shutter, energizing the gaskets 12 by means of a pressurized fluid which pushes the gaskets towards the upper and lower surfaces of the portion P2 of the shutter, the hydraulic seal of the valve V is guaranteed in a closed configuration. In order for the selectively pressurizable fluid to energize the gaskets 12, suitable channels 13 in fluidic connection between the source of pressurized fluid and the housing of the gaskets 12 are provided within the first sealing collar 10 and the second sealing collar 11. In a preferred embodiment of the disclosure as previously described, the gaskets 12 are of elastomeric material.

Figure 8:
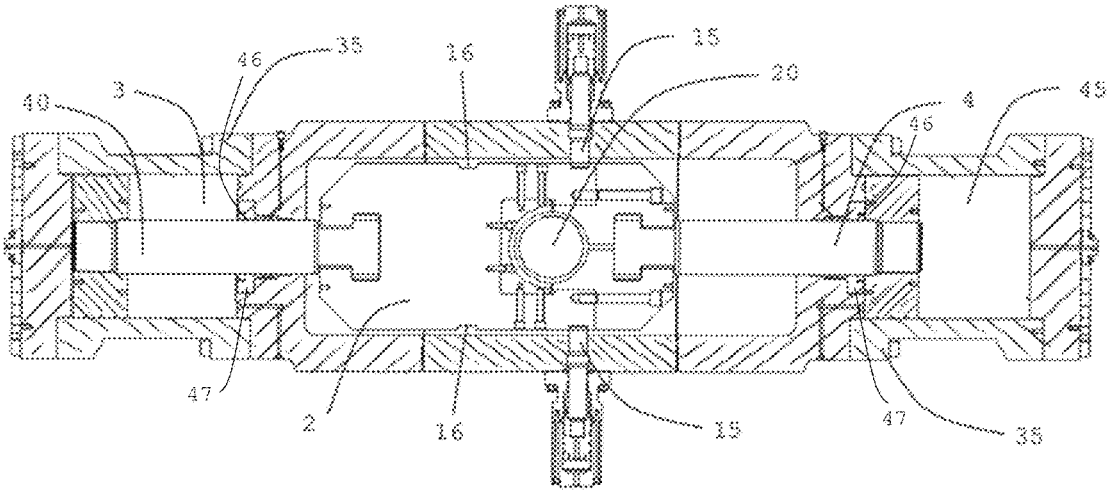
FIG. 8 is a detailed sectional view, with parts removed for clarity's sake, of the safety valve showing the locking mechanism of the cutting shutter by means of a locking pin.

With reference to FIG. 8, in a further preferred embodiment of the disclosure, the valve V as described in any of the previously described embodiments comprises at least one locking pin 15, selectively operated in a reversible manner, characterized by being able to pass from a first retracted position to a second protruding position in which the locking pin 15 engages a corresponding recess 16 obtained in the cutting shutter 2 preventing its movement. This prevents any unwanted movement of the cutting shutter 2 and avoids the risk of loss of hydraulic seal in a closed configuration due to any abnormal thrusts caused by well pressures.

In a preferred configuration of the disclosure as described in any of the previously shown embodiments, the cutting shutter 2 is provided with at least one recess 16, more preferably with at least two recesses corresponding to the open valve and closed valve positions, respectively.

It is therefore evident that the safety valve V, object of the present disclosure, can be configured in at least three different arrangements: a first arrangement comprising the double-acting main hydraulic cylinder 40 but not comprising the closing collar 5 and none of the mechanisms for moving the same; a second arrangement which, with respect to the first one, further comprises the closing collar 5 and a double-acting secondary hydraulic cylinder 45 enslaved to the movement of the closing collar 5. The safety valve V, object of the present disclosure, can therefore be configured in a modular manner according to the cutting capacity to be expressed. The absence of the secondary hydraulic cylinder 45 makes it possible to reduce the size and weights of the valve V, ensuring a greater versatility of use.

Figure 4:
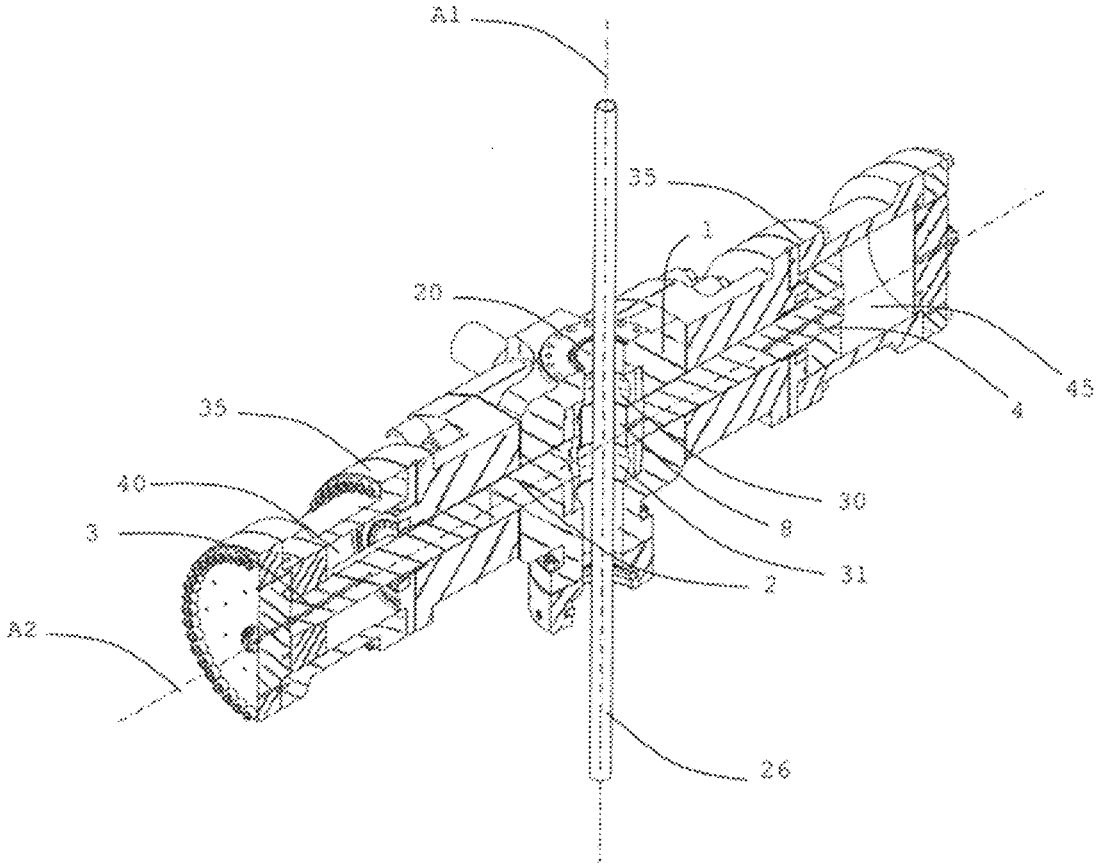
FIG. 4 is an axonometric view with parts in section of the safety valve, with components removed for clarity's sake, showing the valve body, the cutting shutter, the closing collar with relative actuation mechanisms, the valve being in the open condition with a tubular element engaged therein.

With reference to FIGS. 4 and 5, the method for intervening to close an extraction well under emergency conditions by actuating the valve V comprises the following steps:

- centering the tubular element 26 with respect to the crossing duct 20 by advancing the cutting shutter 2 by pressurizing the main hydraulic cylinder 40; centering the tubular element 26 before the actual shearing makes the shearing operation much more efficient avoiding the dangers of generating debris or burrs that interfere with the motion of the cutting shutter 2;
- cutting the tubular element 26 by raising the hydraulic pressure of the main hydraulic cylinder 40; after centering in the previous step, the cutting shutter 2 triggers the cutting step by raising the force applied to the tubular element 26;
- removing the tubular portion 27 by further advancing the cutting shutter 2; the cutting shutter 2, continuing its linear motion along the axis A2, receives the tubular portion 27 in the through opening 8 and disengages it from the crossing duct 20;
- stopping the flow of fluids through the valve V; the cutting shutter 2, continuing its linear motion along the axis A2, engages its second portion P2 in the crossing duct 20, stopping the flow of the well fluids;
- obtaining the hydraulic seal inside the valve V; the cutting shutter 2, being engaged in an interfering manner with the hydraulic seal collars 10 and 11 in the second portion P2 with thickness S2, creates the sealing conditions with respect to the passage of the well fluids;
- locking the cutting shutter 2 in the closed position using at least one locking pin 15; when the cutting and hydraulic sealing steps are completed, in order to avoid unwanted movements of the cutting shutter 2 it is appropriate to prevent its sliding movements along the axis A2 by means of the at least one locking pin 15.

In a preferred configuration of the method for intervening to close an extraction well under emergency conditions, the step of obtaining the hydraulic seal inside the valve V comprises the further step of energizing the gaskets 12 by means of pressurized fluid.

The actuation of the safety valve V is of the reversible type to allow the well to be restored if this is possible.

The method for intervening to reopen the extraction well by actuating the valve V comprises the following steps:

- unlocking the cutting shutter 2 by retracting at least one locking pin 15; after unlocking, the cutting shutter 2 is again free to move slidingly along the axis A2;
- retracting the cutting shutter 2 to the start position, freeing the crossing duct 20; by returning the cutting shutter 2 to the initial condition before shearing the tubular element 26, the crossing duct 20 is freed and the flow of fluids through the safety valve V is restored;

locking the cutting shutter 2 in the opening position by means of at least one locking pin 15; in order to avoid unwanted movements of the cutting shutter 2 it is appropriate to prevent its sliding movements along the axis A2 by means of the at least one locking pin 15.

In particular cases, as a result of the shearing of the tubular element 26, debris or a tubular portion 26 of such a shape as to interfere with the subsequent re-opening movement of the cutting shutter 2 may be produced. By suitably monitoring the stroke of the cutting shutter 2 or the hydraulic pressure in the main 40 and secondary 45 cylinders or by combining the position and pressure information, it is possible to understand whether the sliding movement for re-opening safety valve V of the cutting shutter 2 is partially or fully prevented. In the event of partial or total blockage of the cutting shutter 2, it is possible to bring the programmed collapse coupling means 6 to failure, obtaining the separation of the closing collar 5 from the shutter itself. In a preferred manner of generating the stress state necessary to bring the coupling means 6 to collapse, the main hydraulic cylinder 40 and the secondary hydraulic cylinder 45 are energized oppositely in order to obtain, by means of the respective pistons, tensile forces that act to separate the closing collar 5 from the cutting shutter 2. In this way, the cutting shutter 2, in its linearly sliding movement of disengagement from the crossing duct 20, does not drag with it the tubular portion 27 which remains housed in the shearing end position.

To this end, in a preferred embodiment of the method for intervening to re-open an extraction well, as previously described, the step of causing the collapse of the programmed failure means 6 by generating a tensional state of traction in the cutting shutter 2 by pressurizing the main 40 and secondary 45 hydraulic cylinders in an opposite manner is included.

The present disclosure further provides an extraction or production well comprising:

- a cemented anchoring tube, or otherwise anchored or fixed to the ground, wherein the tube is located near the surface of the ground;
- a wellhead located at or near the end of the first anchoring tube;
- a safety valve V having the characteristics according to one or more preceding claims and mounted on the wellhead;
- a tubular element 26, typically metallic, contained at least partially inside the well and oriented in the same axial direction as the well itself; the tubular element 26 being internally hollow and predisposed to contain and transport the fluids and other substances extracted through the well, including hydrocarbons (oil or natural gas), water, mud, rock debris and/or soil debris.

The well as described above, in a preferred embodiment, comprises one or more blow-up preventers (BOP) or other safety valves.

It has thus been seen that the safety valve for wells for the extraction of hydrocarbons according to the present disclosure achieves the advantages highlighted above, obtaining numerous advantages including:

- shearing action of the tubular elements facilitated by the development of preferential fracture planes with a simple mechanism and with a low number of moving components in the safety valve V in a thus simpler way than known devices considering the variety of geometries to be cut: from the tool joints to the casings;
- creation of a defined shearing surface in order to avoid the production of metal debris that prevents the subsequent passage of the closing element;
- ability to perform the shearing of the tubular elements even under critical conditions;
- protection of the hydraulic piston seals from the well fluids, so that the maintenance of the seals is avoided and the safety valve remains installed for the entire operating life of the well.

The safety valve for wells for the extraction of hydrocarbons of the present disclosure thus conceived is susceptible to many modifications and variants, all falling within the same inventive concept; furthermore, all the details can be replaced by technically equivalent elements. The materials used, as well as the shapes and dimensions, may in practice be of any type according to the technical requirements.

The invention claimed is:

1. A safety valve comprising: a valve body, inside which is formed a crossing duct, configured to be crossed by a production or drilling line configured to contain and transport, through a tubular element, extraction fluids or other fluids to be extracted from an underground field, the valve being provided with a cutting shutter selectively sliding linearly along an axis which intersects in a substantially orthogonal the longitudinal axis of the crossing duct, the safety valve further defined by:

- the cutting shutter comprises a through opening in the direction of the longitudinal axis, the through opening extending on the side facing the tubular element substantially configuring a "U" opening, suitable for internally smoothly receiving a tubular material portion in linear motion during the shearing operation; and
  - the cutting shutter comprises cutting inserts in a material of higher hardness than that of the cutting shutter, installed on the edges of the through opening, the cutting inserts defining two different shearing planes in the tubular element; and
- the valve comprises a first hydraulic sealing collar and a second sealing collar, installed in a seat formed in the crossing duct;
- the cutting shutter comprises a first portion, equipped with cutting inserts, characterized by a first thickness and a second portion characterized by a second thickness greater of the first thickness so that, in the linear sliding feed motion, once the shearing of the tubular element has taken place, the second portion of the cutting shutter engages the hydraulic seal collars in an interfering manner, making a hydraulic seal.

2. The valve according to claim 1, wherein the valve body comprises cutting inserts abutment, installed inside the crossing duct respectively opposite to the cutting inserts contributing to the definition of the two different cutting planes.

3. The valve according to claim 1, wherein the cutting inserts are configured with a "V" shape in their part that comes into contact with the tubular element.

4. The valve according to claim 1, wherein the cutting shutter comprises a closing collar, coupled with the cutting shutter on the side facing the tubular element (26) by programmed failure coupling means, to configure the through opening as having a substantially circular section and such that, in predetermined conditions of stress state, the programmed failure means collapse releasing the cutting shutter from the closing collar.

5. The valve according to claim 4, wherein the programmed failure coupling means are selected from the group consisting of screws, bolts, plugs, and pins.

6. The valve according to claim 4, wherein the programmed failure coupling means are provided with at least a notch designed to the determination of predefined failure zones.

7. The valve according to claim 1, wherein the cutting shutter is moved by a double-acting main hydraulic cylinder with a main hydraulic piston connected to the cutting shutter.

8. The valve according to claim 7, further comprising a double-acting secondary hydraulic cylinder, connected to the closing collar, with a secondary hydraulic piston substantially coaxial and diametrically opposite to the main hydraulic piston.

9. The valve according to claim 1, wherein hydraulic seals of the pistons of the hydraulic cylinders are protected from well fluids by elastic bellows.

10. The valve according to claim 1, wherein the hydraulic seal collars are provided with gaskets energizable by a selectively pressurizable fluid which pushes the gaskets towards the upper and lower surfaces of the second portion of the cutting shutter, the gaskets being in fluidic connection with a source of pressurized fluid by channels formed inside the sealing collars.

11. The valve according to claim 1, further comprising at least one locking pin, selectively operated in a reversible manner, configured to pass from a first retracted position to a second protruding position in which the locking pin engages a corresponding recess obtained in the cutting shutter preventing its movement.

12. The valve according to claim 1, further comprising an independent remote power and control system, installed at a predefined distance from an extraction well, connected to the valve by electrical and hydraulic connections.

13. An extractive well comprising:

a cemented anchoring tube, configured to be anchored or fixed to the ground, wherein the anchoring tube is located near the surface of the ground;

a wellhead located at or near the end of the anchoring tube;

a safety valve having the characteristics according to claim 1 and mounted on the wellhead.

14. The extractive well according to claim 13, further comprising one or more blow-up preventers or other safety valves.

* * * * *